US005163073A

United States Patent [19]

Chasteen et al.

[11] Patent Number: 5,163,073

[45] Date of Patent: Nov. 10, 1992

[54] CAN END COUNTING SYSTEM

[75] Inventors: Howard C. Chasteen, Westminster; Todd W. Farley, Golden; Richard P. Cramer; Michael J. Lockner, both of Arvada, all of Colo.

[73] Assignee: Ball Corporation, Muncie, Ind.

[21] Appl. No.: 670,646

[22] Filed: Mar. 18, 1991

[51] Int. Cl.[5] ..... G06M 7/06; G06M 3/02

[52] U.S. Cl. ..... 377/8; 414/795.1; 414/795.6; 414/797.7; 414/788.4; 414/798.4; 414/798.5; 414/901; 377/28

[58] Field of Search ..... 377/6, 8, 28; 414/788.2, 795.6, 795.1, 797.7, 798.5, 798.4, 798.9, 788.4, 901

[56] References Cited

U.S. PATENT DOCUMENTS

| | | | |
|---|---|---|---|
| 2,999,520 | 9/1961 | Lowman | 377/6 |
| 3,420,149 | 1/1969 | Middleditch et al. | 414/901 |
| 4,044,896 | 8/1977 | Reinecke | 414/795.6 |
| 4,390,779 | 6/1983 | Heikel | 377/6 |
| 4,560,159 | 12/1985 | Staub | 377/8 |
| 4,694,474 | 9/1987 | Dorman | 377/6 |
| 4,987,721 | 1/1991 | Turtschan | 414/797.7 |
| 5,005,340 | 4/1991 | Mojden | 414/798.5 |

*Primary Examiner*—John S. Heyman
*Attorney, Agent, or Firm*—Gilbert E. Alberding

[57] ABSTRACT

A can end counting system which receives a stick of converted can ends, separates and counts the can ends, restacks and conveys a pre-determined number of can ends comprising an output stick to an end line packaging station. At least two counter-rotating screws, each having a separator knife positioned at the entrance end thereof, are provided with a continuous spiral groove cut into the periphery and coact with each other to separate the can ends, one by one, from an input stick and increasingly separate the can ends as they are carried toward the exit end of the device. A sensing device senses each of the can ends as they are carried toward the exit end of the device and sends a signal to a processing device which stores the total number of can ends included in a current output stick and controls a cut-off knife which separates and conveys the output stick toward an end line packaging station when a pre-determined number of can ends is attained.

20 Claims, 5 Drawing Sheets

CAN END COUNTING SYSTEM

FIELD OF THE INVENTION

This invention relates to the handling of articles, and more particularly relates to an apparatus and method for separating converted can ends from an input stick of converted can ends, accurately counting the number of can ends to be included in an output stick of converted can ends, and conveying each of the output sticks of converted can ends to an end line packaging station.

BACKGROUND OF THE INVENTION

Current methods for counting converted can ends in a stick of can ends employ mechanical counters using a notched wheel which rides on top of the converted can ends. The mechanical counter must exert a uniform tension on the can ends at all times to work properly. "Spong-y-ness" is a common problem among systems using such mechanical counters and is caused by slippage of the mechanical wheel with a resultant decrease in accuracy of the system. Currently, systems using mechanical counters can achieve an accuracy of only plus or minus three can ends per 480 can ends included in each output stick. Consequently, to avoid shorting customers, extra converted can ends are included in each output stick with a resultant cost increase to the manufacturer.

Systems using various methods to separate a continuous input supply of nested articles are well known. For example, U.S. Pat. No. 3,661,075 to Amberg discloses an apparatus and method for printing a design on any surface of revolution with a straight line generatrix such as cups or other cylindrical containers. The cups enter the apparatus in a nested stack and a radially extending lip on the surface of each cup is engaged by grooves cut into the periphery of two counter rotating cylinders. The grooves are formed in such a way as to cant the outer surface of the cups at an angle parallel to a rotatable print cylinder allowing a design to be printed on the cups. The rotatable print cylinder also functions as a third cylindrical support surface for the cups as they pass from the entrance end to the exit end of the device. The system and method of U.S. Pat. No. 3,661,075 uses counter rotating screws to separate and advance a nested stack of cups past a rotatable print cylinder but does not disclose any means for counting, restacking and separating sticks of objects into sticks of a known number.

U.S. Pat. No. 2,433,736 to Carew describes an apparatus for removing and delivering a cup from a nested stack into an operative position to receive fluid or semi-fluid contents. The device uses a plurality of circularly arranged cup delivery worms used to separate each cup from the nested stack of cups, hold the cup with projections comprising a cup holding station until the cup is needed, and immediately release the cup from the cup holding station permitting it to drop to a drink supply mechanism for filling with a liquid or semi-liquid. Like the Amberg patent described above, the Carew patent does not include means to count the cups as they pass through the device, or any means to restack and to separate the restacked objects into sticks of a known number.

Other methods for separating articles from a nested input stack are also employed and well known. U.S. Pat. No. 4,545,714 to Johnson et. al., for example, discloses an apparatus and method for receiving a continuous supply of nested containers and separating the nested containers into stacks having a requisite number of cups included therein. Johnson uses a rotating wheel with outwardly extending resilient members having diverging side arm portions attached thereto. The rotating wheel causes the diverging side arm portions to engage a rim portion present on each of the cups and transmit each of the cups toward the exit end of the device. At the same time, an endless conveyor chain rotates at a slightly faster speed than the rotating wheel and engages the rim portion of a container with an outwardly projecting clip at a pre-determined interval. Through suitable synchronization between the rotational speed of the rotating wheel and linear speed of the endless conveyor chain, a stack of containers having a predetermined count can be attained. U.S. Pat. No. 4,545,714 does not use rotating screws to separate the nested articles or a sensing device to count the articles.

Sensing devices used to accurately count articles are well known in the manufacturing industry. For example, U.S. Pat. No. 3,774,649 to Ward describes a system for counting and separating corrugated boxes into squared bundles. Ward uses a belt conveyor to convey flat corrugated boxes past an electric eye and into a hopper. As each flat box is conveyed past the electric eye, the count of boxes included in the bundle is increased by one. The boxes are fed into the bottom of the hopper, one by one, and when a predetermined number of boxes is attained, a stop bar is positioned to separate the current bundle from the next bundle. Boxes continue to enter the hopper and when a second electric eye positioned above the bundle senses a predetermined height of boxes, the first bundle is removed from the hopper and conveyed from the system.

None of these systems provides means for separating long sticks of converted can ends into sticks having a known number of can ends by separating, counting and restacking the can ends into stacks of exact count and do not provide an exact count of can ends to be shipped to a customer.

DISCLOSURE OF THE INVENTION

This invention provides means for receiving an input stick of converted can ends, separating, one by one, and accurately counting the can ends to be included in an output stick, and stacking and conveying an output stick having a pre-determined number of can ends to an end line packaging station.

In general, the invention comprises means for supplying an input stick of converted can ends to the entrance end of a can end counting device through an input guide tube. Where in this application we refer to the "entrance end" we mean the end of the apparatus which receives an input stick of converted can ends; and where in the application we refer to the "exit end" we mean the end of the apparatus which conveys an accurately counted output stick of converted can ends to an end line packaging station.

The can end counting device has at least two counter rotating screws, each having a continuous spiral groove cut into the periphery extending from the entrance end to the exit end. At the entrance end of each of the counter rotating screws is a separator knife which separates the converted can ends from the input stick, one by one, and provides proper alignment of each can end for engagement by the grooves in the counter rotating screws. The grooves have a geometry causing the can ends to be increasingly separated as they are carried from the entrance end toward the exit end of the counter rotating screws. At least one sensing device, located between the entrance end and exit end, preferably about two-thirds of the distance toward the exit end of the counter rotating screws, senses each can end as it passes by the sensing device and transmits an electric signal to a processing device. The two counter-rotating screws are adapted to restack the can ends after they are counted.

A processing device stores a pre-determined number representing the total number of can ends to be included in each output stick and receives the electric signals from the sensing device indicating that a can end has been counted. The number of can ends included in the current output stick is increased by one each time a signal is received by the sensing device and when the total number of cans in the output stick is equal to the stored pre-determined number to be included in each output stick, the processing device sends an electric signal to a control device. The control device controls the position of a cut-off knife, which separates the output stick from the input stick. The output stick can then be conveyed to packaging apparatus such as an end line packaging station.

In the invention no mechanical wheels are employed to count the can ends to be included in an output stick. Such systems tend not to give an exact count of the number of can ends included in an output stick because of the spong-y-ness problem described above. In contrast, the at least one sensing device employed in our invention only counts those can ends actually carried toward the exit end of the counter rotating screws and eliminates the necessity to include extra can ends in an output stick (to avoid shorting customers). Further, quality assurance costs are reduced because of an increase in reliability and accuracy.

BEST MODE FOR CARRYING OUT THE INVENTION

Figure 1:
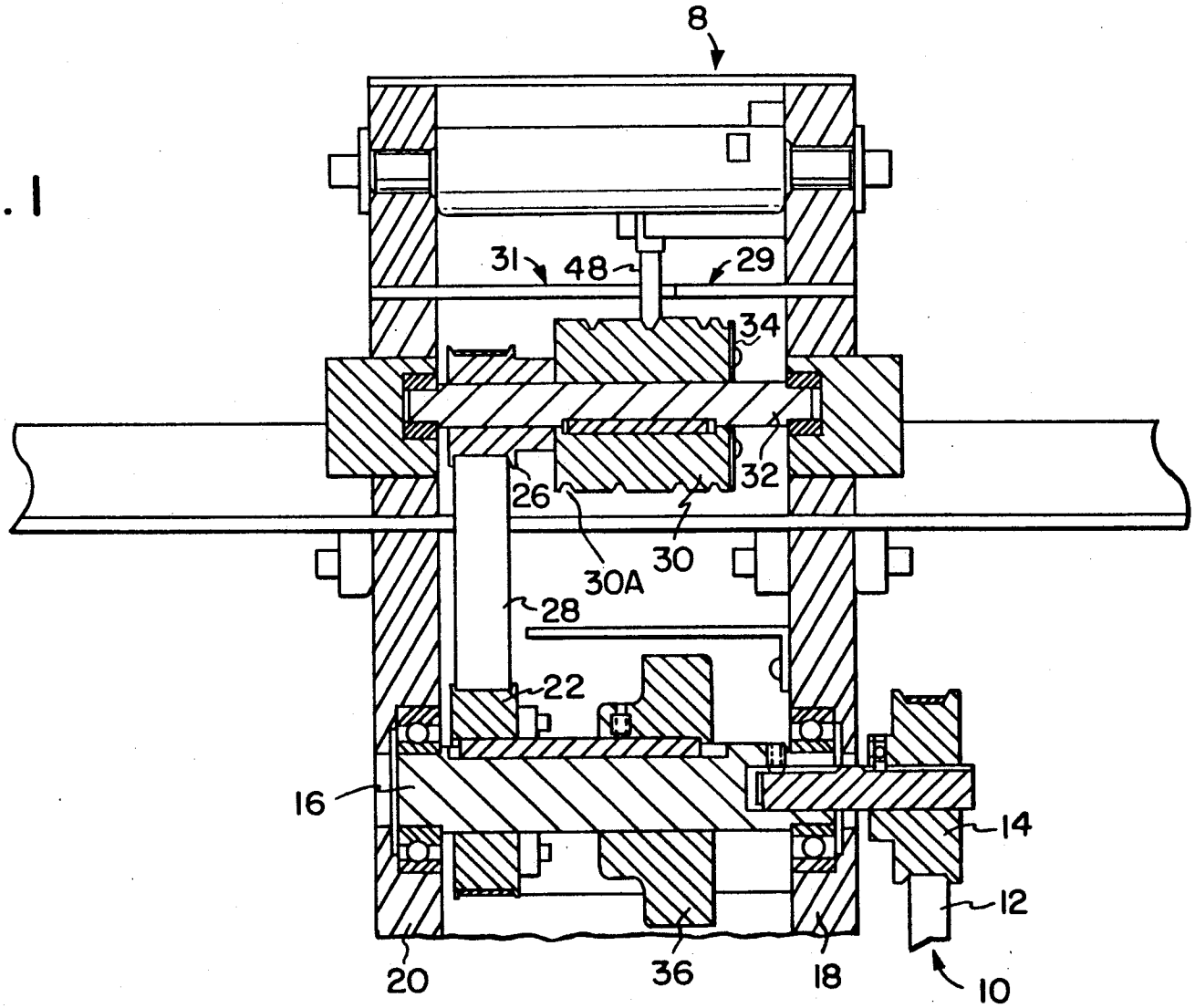
FIG. 1 illustrates a side view of the mechanical apparatus of the invention not including a control device, processing device or external pressure source.
Figure 4:
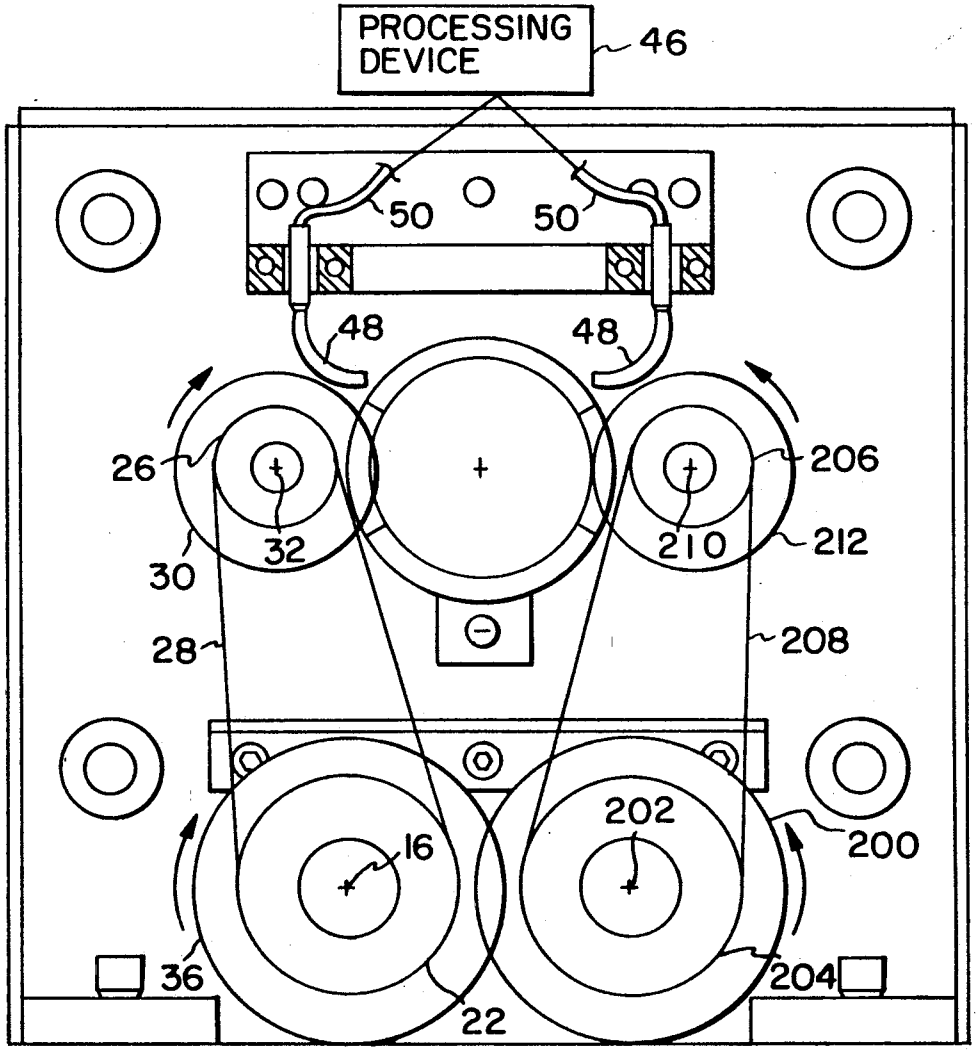
FIG. 4 is an end view from the right of FIG. 1 with an indication of the respective rotation directions of the pulleys, spur gears, and counter rotating screws.
Figure 5:
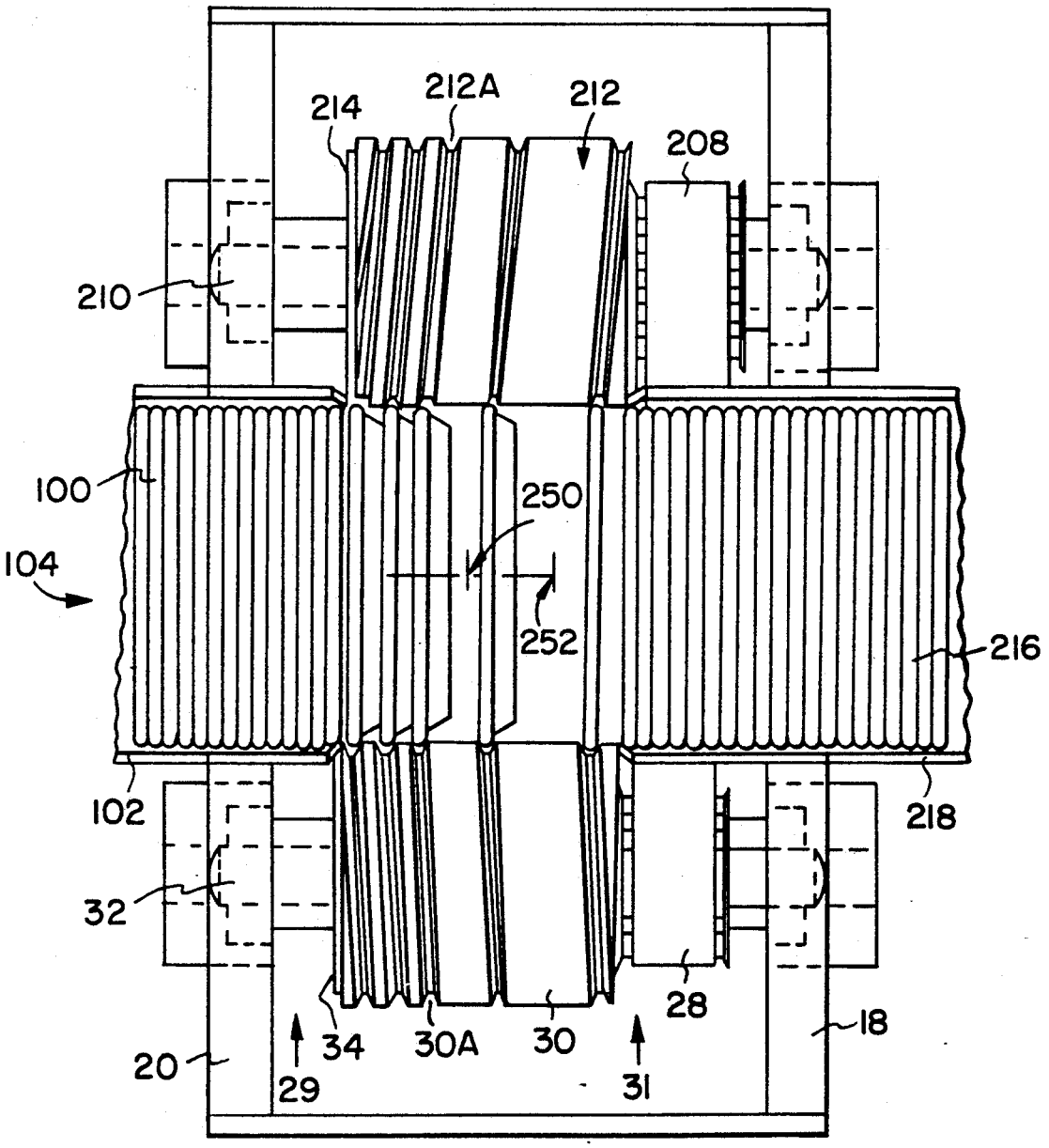
FIG. 5 is a top view of the preferred embodiment showing engagement of the converted can ends by the at least two counter rotating screws during operation.

FIG. 1 shows a side view of the mechanical apparatus of a can end counting device 8 without mechanical or electrical apparatus necessary to effect separation of an output stick of can ends 216, shown in FIG. 5. A driving means 10 supplies rotational input power to the can end counting device 8 and is connected to a pulley 14 by a drive belt 12. The driving means 10 can be any input power source such as an electric motor with an appropriately sized pulley attached thereto. The pulley 14 is rigidly connected to a drive shaft 16 which in turn is connected to support members 18 and 20 by any convenient connecting means allowing free rotation of drive shaft 16, e.g., a tapered roller bearing. Pulley 22 is rigidly connected to drive shaft 16 and provides input power to pulley 26 via a drive belt 28. Pulley 26 and a first counter rotating screw 30 are rigidly connected to shaft 32 which is fastened to support members 18 and 20 by any means allowing free rotation of shaft 32. At the entrance end 29 of the first counter rotating screw 30 is a separator knife 34. A continuous spiral groove **30*a* extends from the entrance end 29 to the exit end 31 of the first counter rotating screw 30. In an alternative embodiment of the invention, not shown, the separator knife 34 can be formed as an integral part of the counter rotating screw 30, e.g., included in a mold used to form counter rotating screw 30. A spur gear 36 is rigidly connected to drive shaft 16 and provides rotational input power to a second spur gear 200, as shown in FIG. 4, allowing a second counter rotating screw 212 to be driven in a like manner as counter rotating screw 30 above through pulleys 204 and 206 and the interconnecting drive belt 208**.

Figure 2:
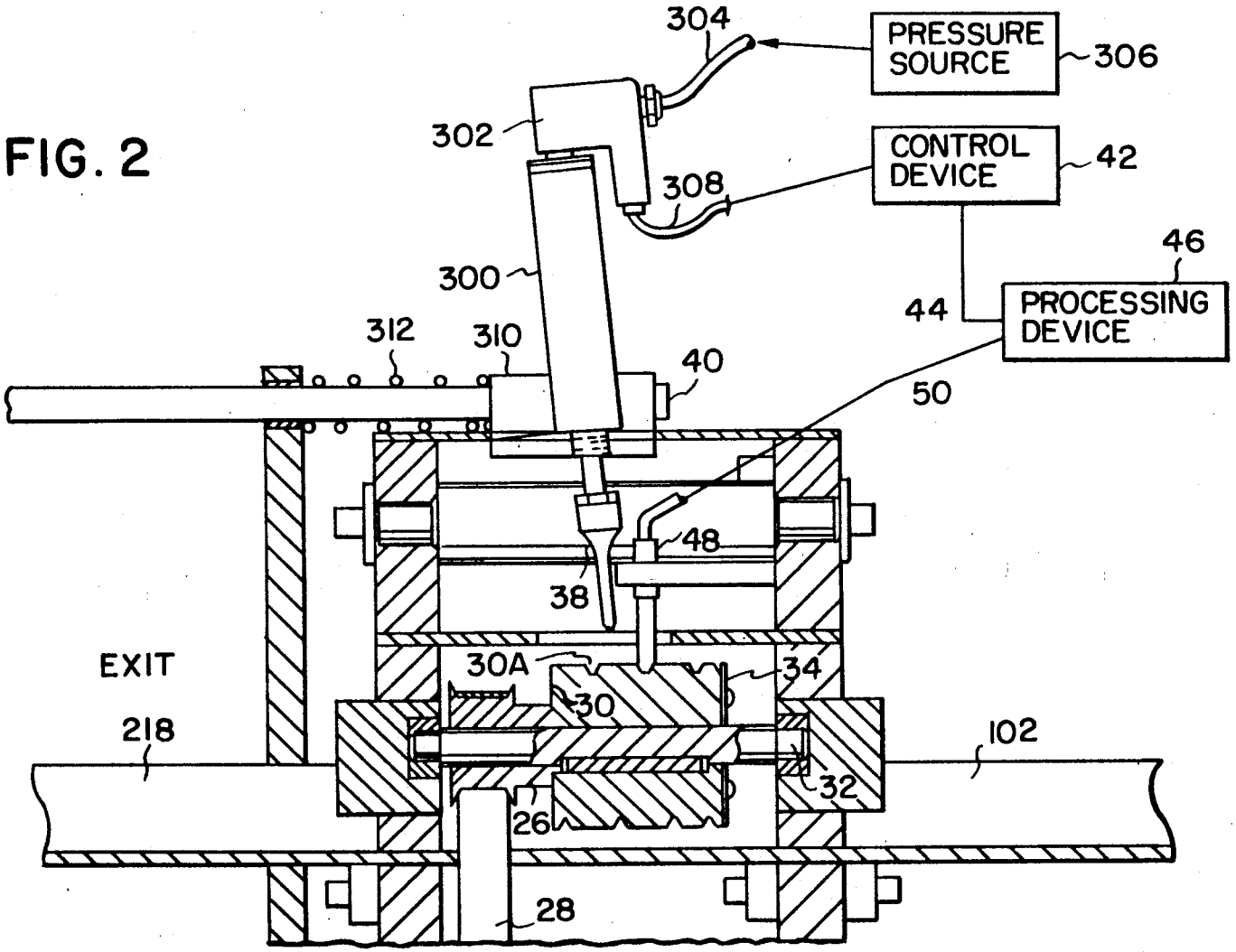
FIG. 2 shows a partial side view of the invention including the at least two counter-rotating screws, cut-off knife assembly, processing device, control device and external pressure source.

FIG. 2 illustrates the apparatus of FIG. 1 with additional mechanical and electrical elements necessary to effect operation of a cut-off knife 38. As shown in FIG. 2, cut-off knife 38 is connected to an air cylinder 300 which is in turn attached to a suitable external pressure source 306 via an air valve 302 and an air inlet tube 304. The air valve 302 is connected via an electrical connection 308 to a control device 42 which is in turn connected via an electrical connection 44 to a processing device 46. The cut-off knife 38 and air cylinder 300 are both rigidly connected to a freely slideable connecting means 310. The freely slideable connecting means 310 is connected to and coacts with a compression spring 312 to provide linear movement under slight pressure along a shaft 40 when the cut-off knife 38 is displaced from its resting position shown in FIG. 2.

Figure 3:
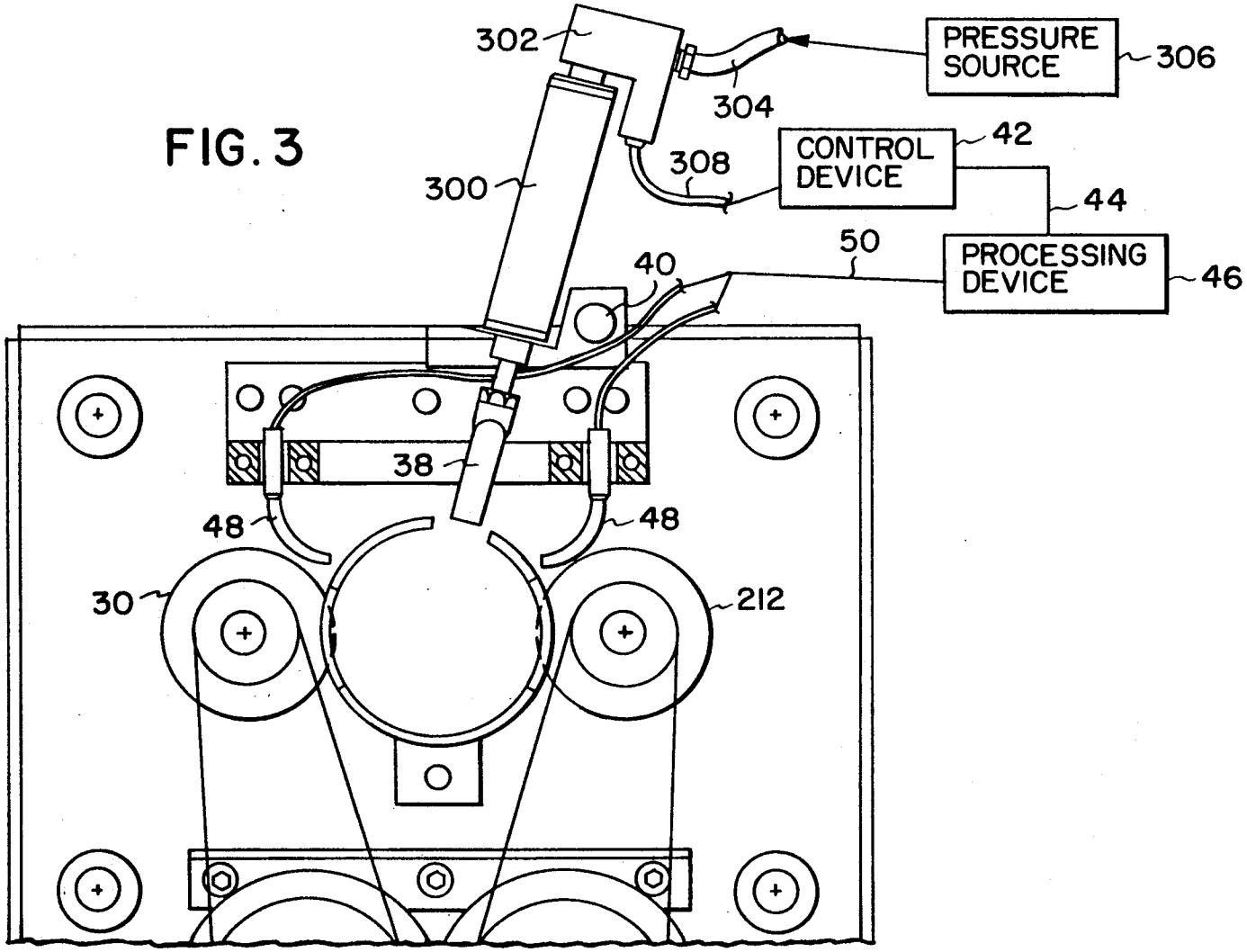
FIG. 3 is an end view of the invention as viewed from the right of FIG. 1 showing interaction of electrical and mechanical components.

Two sensing devices 48, shown in FIGS. 3 and 4, are connected to the processing device 46 via an electrical connection 50 and can be fastened to support member(s) 18 and/or 20 by any convenient means allowing proper placement of the sensing device 48 as shown in FIG. 1. In a preferred embodiment of the invention, the sensing devices 48 are fiber optic sensors, but in other embodiments could be proximity detectors, micro switches, or other similar type sensors capable of detecting the edge of a converted can end.

Although FIG. 1 shows the currently known best mode for transferring power via pulleys, belts, and spur gears, other methods could be employed in practice and are within the scope of this invention. For example, in an alternative embodiment of the invention, not shown, the driving means 10 can be rigidly fastened directly to drive shaft 16 providing input power to pulley 22 and spur gear 36. Likewise, spur gear 36 and corresponding spur gear 200 shown in FIG. 2 could be replaced with two pulleys and a drive belt to provide input power to shaft 202.

FIG. 4 shows an end view of the can end counting device as viewed from the exit end. As shown, the first spur gear 36 is enmeshed with and provides input power to a second spur gear 200 which rotates in an opposite direction. The second spur gear 200 is rigidly connected to a shaft 202 which transfers power to a pulley 204. A pulley 206 receives rotational input power from the pulley 204 via a belt 208 and is rigidly connected to shaft 210 which provides rotational power to a second counter rotating screw 212. Thus, it is apparent that elements 200–212 are mirror images to elements 16, 22–32, and 36 and first counter rotating screw 30 rotates at the same angular speed as second counter rotating screw 212.

During operation, converted can ends comprising an input stick 100, shown in FIG. 5, are enclosed within an input guide tube 102, shown in FIGS. 1 and 3, and are urged into contact by mechanical means or gravity 104 with separator knives 34 and 214 positioned at the entrance end 29 of the two counter rotating screws 30 and 212. The separator knives 34 and 214, which can be eccentrically mounted on shafts 32 and 210, separate the can ends, one by one, from the input stick 100 and provide proper alignment of the can ends for engagement by the continuous spiral grooves 30*a* and 212*a* which are formed into the periphery of the two counter rotating screws 30 and 212. As shown in FIG. 5, the can ends are increasingly separated from each other as the can ends progress from the entrance end 29 to the exit end 31 of the device.

An added advantage of this invention is that can ends which are jammed together from material deformation, adhesion, vacuum, etc. are separated from each other as they are transferred toward the exit end 31 of the device.

At location 250 the separated can ends pass between fiber optic sensors 48 (FIGS. 1–4) and an electrical signal is sent to the processing device 46 via an electrical connection 50. The processing device can be any micro-processor, e.g., a personal computer, and receives input from the fiber optic sensors 48 and controls the cut-off knife 38. Upon receiving a signal from the fiber optic sensors 48, the processing device increases by one (1) the number of can ends included in the current output stick 216. When a predetermined number of can ends to be included in the output stick 216 is attained, the processing device 46 sends an electric output signal via electrical connection 44 to a control device 42. The control device 42 actuates a high speed air valve 302 and allows compressed air to flow from an air inlet tube 304 into an air cylinder 300. The air inlet tube 304 is connected to a suitable commercially available external pressure source 306 (see FIGS. 2 and 3). The sudden increase in pressure within air cylinder 300 causes a cut-off knife 38 to extend into and between the can ends at separation location 252 shown in FIG. 5. The cut-off knife 38 and air cylinder 300 are attached to shaft 40 by suitable connecting means 310 allowing movement in a generally linear direction parallel to the axis of shaft 40. As the two counter-rotating screws 30 and 212 continue to transmit can ends toward the rear of the counting device, the cut-off knife 38 and air cylinder 300 are moved along shaft 40 toward the exit end of the counting device 8. A linear compression spring 312 applies a small force to the freely slideable connecting means 310 as the can ends push the cut-off knife 38, air cylinder 300 and connecting means 310 toward the exit end of the counting device 8. When the cut-off knife 38 is moved beyond counter-rotating screws 30 and 212 at the exit end of the counting device 8, a shuttle device 314, shown in FIG. 2, engages and conveys the output stick of can ends 216 to an operator for manual packaging or to an end-line packaging station for automatic packaging. The control device 42 then sends a signal, via an electrical connection 308, to the air valve 302 which releases the pressure exerted on cut-off knife 38. The cut-off knife 38 is retracted to an unextended position as shown in FIGS. 2 and 3 and returns to a resting position shown in FIG. 2. The total number of can ends included in the current output stick is then reset to zero (0), the cut-off knife 38 is returned to its original position shown in FIG. 2 and the process is repeated.

Although FIG. 5 shows the separator knives 34 and 214 as separate thin metallic elements attached to the two counter rotating screws 30 and 212, the separator knives 34 and 214 could be included as part of counter rotating screws 30 and 212, i.e., included as part of a mold used to form counter rotating screws 30 and 212. Further, the invention can incorporate more than two counter rotating screws to transfer the converted can ends from the entrance end to the exit end of the device. Moreover, in addition to counting the number of can ends to be included in each output stick, the processing device can also be used to count the total number of can ends over any given period of time, i.e., total production rates, or even control packaging apparatus used to package multiple output sticks. Additionally, the control device 42 can be included as part of the processing device 46, i.e., the mechanical and electronic hardware of the control device 42 and processing device 46 can be incorporated into a single electronic package. Such embodiments are considered within the scope of this invention.

While the preceding description illustrates the presently known best mode for carrying out the invention, the scope of this invention is not limited, as will be apparent to those skilled in the art, to the described best mode and is limited only by the scope of the invention, following claims, and the prior art.

We claim:

1. An apparatus for receiving a stack of disk-like objects, separating and counting said disk-like objects, and restacking and conveying a pre-determined number of said disk-like objects toward an end line packaging station, said apparatus comprising:

means for supplying an input stack of disk-like objects to at least two counter-rotating screws;

each of said at least two counter-rotating screws being provided with a continuous spiral groove cut into the periphery thereof extending from an entrance end to an exit end of said at least two counter-rotating screws, said at least two counter-rotating screws engaging each of the disk-like objects of said input stack, separating the disk-like objects one by one from the input stack, and carrying the disk-like objects to their exit ends;

a separator knife positioned at the entrance end of each of said at least two counter-rotating screws providing separation of said disk-like objects, one by one, from said input stack;

at least one sensing device positioned for sensing each of the disk-like objects after separation from the input stack as the disk-like objects are carried to the exit ends of said at least tow counter-rotating screws, said at least two counter-rotating screws being adapted to separate said disk-like objects by an increasing distance as said objects are carried toward said at least one sensing device and the exit end of said at least two counter-rotating screws;

a cut-off knife for separating an output stack of disk-like objects from said input stack of disk-like objects;

a processing device for storing information comprising a pre-determined number of disk-like objects to be included in said output stack, for receiving electric signal inputs from said sensing device indicating that a disk-like object has been carried past said sensing device, for storing information comprising the total number of disk-like objects which have been carried past said sensing device since the last output, and for controlling said cut-off knife independently of said at least two counter-rotating screws to separate said output stack from said input stack and convey said output stack to an end line packaging station when the number of disk-like objects carried past the sensing device equals the pre-determined number, said at least two counter-rotating screws being adapted to restack said disk-like objects into a nested output stack after carrying said objects past said sensing device.

2. The apparatus of claim 1 further comprising:

an external power source for transmitting rotational input power to one of said at least two counter-rotating screws;

a first spur gear receiving rotational input power from said external power source;

a second spur gear enmeshed with said first spur gear, and receiving rotational input power therefrom, said second spur gear rotating in a direction counter to said first spur gear during operation and being connected to at least one additional counter-rotating screw so as to provide rotational input power thereto.

3. The apparatus of claim 2 wherein said second spur gear is connected to said at least one counter-rotating screw(s) via two pulleys and a drive belt.

4. The apparatus of claim 2 wherein said second spur gear is connected to said at least one counter-rotating screw(s) via two gears and a drive chain.

5. The apparatus of claim 1 wherein said at lest one sensing device and said processing device coact to count only those disk-like objects which are actually carried past said sensing device.

6. The apparatus of claim 1 wherein said at least one sensing device coacts with said processing device to determine the number of disk-like objects in each output stack at a location corresponding to about one revolution of the lead screw (with respect to the direction of travel of said disk-like objects) from said cut-off knife.

7. The apparatus of claim 1 wherein said at least one sensing device is selected from a group consisting of a fiber optic sensor, proximity detector, and micro-switch.

8. The apparatus of claim 1 wherein said processing device controls said cut-off knife by sending an electric signal to a control device which in turn mechanically operates said cut-off knife.

9. The apparatus of claim 1 wherein said processing device controls at least one packaging apparatus used to package said output stacks.

10. The apparatus of claim 9 wherein said end line packaging apparatus functions to package multiple output stacks of said disk-like objects.

11. The apparatus of claim 1 wherein said processing device controls said cut-off knife by sending an electrical signal to a control device which in turn mechanically controls said cut-off knife.

12. An apparatus for receiving an input stick of converted can ends, separating and counting said can ends, and renesting and conveying a pre-determined number of said can ends towards an end line packaging station comprising:

means for supplying converted can ends to an entrance end of two counter-rotating screws in a nested stick with extending can end edges;

said two counter-rotating screws being provided with a continuous spiral groove cut into the periphery extending from the entrance end to an exit end of said two or more counter-rotating screws for engaging the extending can end edges and separating said converted can ends;

a separator knife positioned at the entrance end of each of said two counter-rotating screws to separate said can ends, one by one, from said input stick, said two counter-rotating screws conveying the separated can ends to their exit end;

at least one fiber optic sensor positioned between said two counter-rotating screws capable of sensing the passage of each can end as it is conveyed from the entrance end to the exit end of said two counter-rotating screws as each of said can ends passes by said fiber optic sensor, said spiral grooves of said two counter-rotating screws being configured so as to increasingly separate said can ends as they approach said fiber optic sensor and to renest said can ends after they pass said fiber optic sensor as they approach the exit end of said two counter-rotating screws;

a cut-off knife for separating an output stick of converted can ends from said input stick of converted can ends;

a processing device for storing information comprising a pre-determined number of can ends to be included in each output stick, for receiving inputs from said fiber optic sensor indicating that a can end has been sensed, for storing information comprising the total number of cans which have passed said fiber optic sensor since the last output stick was conveyed to an end line packaging station, and for controlling said cut-off knife to separate said output stick from said input stick and convey said output stick to an end line packaging station, said processing device coacting with said fiber optic sensor to count only those can ends which are actually carried from the entrance end to the exit end of said two counter rotating screws;

an external power source for transmitting rotational input power to a first counter-rotating screw;

a first spur gear receiving rotational input power from said external power source;

a second spur gear enmeshed with said first spur gear, and receiving rotational input power therefrom, said second spur gear being caused to rotate in a direction counter to said first spur gear during operation; and a drive belt connecting said second spur gear to a second counter-rotating screw for transmitting power from said second spur gear to said second counter-rotating screw.

13. A method for separating, counting, and restacking disk-like objects into an output stack and conveying a pre-determined number of said disk-like objects toward an end line packaging station, said method comprising the steps of:

supplying an input stack of disk-like objects with protruding edges;

engaging the protruding edges of said disk-like objects by continuous spiral grooves provided in the periphery of said at least two counter-rotating screws and carrying said disk-like objects toward an exit end of said at least two counter-rotating screws;

increasingly separating said disk-like objects, one from another, as said disk-like objects are carried toward the exit end of said at least two counter-rotating screws;

counting each disk-like object after it is separated from the input stack with at least one sensing device as said can end is carried toward the exit end of said at least two counter-rotating screws;

monitoring the total number of disk-like objects which have been counted and carried to the exit end of the at least two counter-rotating screws;

renesting said disk-like objects in an output stack at the exit end of said counter-rotating screws after said disk-like objects have been carried past said sensing device; and operating a cut-off knife when a pre-determined number of said disk-like objects has been moved to the exit end of the at least two counter-rotating screws so that the output stack is separated from said input stack and is conveyed towards an end line packaging station.

14. The method of claim 13 comprising the further step of separating said disk-like objects from said input stack, one by one, with a separator knife which is attached to the entrance end of said at least two counter-rotating screws.

15. The method of claim 13 further comprising the step of resetting the total number of disk-like objects which have been counted to zero (0) after said output is conveyed towards said end line packaging station.

16. The method of claim 13 further comprising the steps of:

transmitting rotational input power from an external power source to a first spur gear and one of said at least two counter-rotating screws;

transmitting power from said first spur gear to a second spur gear which rotates in a direction counter to the first spur gear; and transmitting power from said second spur gear to at least one additional counter-rotating screw.

17. The method of claim 13 comprising the further step of providing said input stack of disk-like objects to said separator knife in a continuous, non-interrupted manner.

18. The method of claim 13 comprising the further step of providing said input stack of disk-like objects to said separator knife in a non-continuous (batch) manner.

19. The method of claim 13 wherein said input stack is supplied by gravitational force to the entrance end of said at least two counter-rotating screws.

20. The method of claim 13 wherein said input stack is supplied by mechanical energy to the entrance end of said at least two counter-rotating screws.

* * * * *